US005984200A

United States Patent [19]

Augustin

[11] Patent Number: 5,984,200

[45] Date of Patent: Nov. 16, 1999

[54] FUEL INJECTION SYSTEM FOR A MULTI-CYLINDER INTERNAL COMBUSTION ENGINE WITH MAGNETIC VALVE CONTROLLED FUEL INJECTORS

[75] Inventor: Ulrich Augustin, Kernen, Germany

[73] Assignee: DaimlerChrysler AG, Stuttgart, Germany

[21] Appl. No.: 09/025,227

[22] Filed: Feb. 18, 1998

[30] Foreign Application Priority Data

Feb. 19, 1997 [DE] Germany ..... 197 06 469

[51] Int. Cl.[6] ..... F02M 47/02

[52] U.S. Cl. ..... 239/88; 239/533.9; 239/585.1

[58] Field of Search ..... 239/88, 94, 96, 239/89, 533.2, 533.9, 585.1, 585.3

[56] References Cited

U.S. PATENT DOCUMENTS

| | | | |
|---|---|---|---|
| 5,323,964 | 6/1994 | Doszpoly et al. | 239/88 X |
| 5,524,826 | 6/1996 | Mueller et al. | 239/533.9 X |
| 5,526,791 | 6/1996 | Timmer et al. . | |
| 5,699,963 | 12/1997 | Ueda | 239/88 |

FOREIGN PATENT DOCUMENTS

| | | |
|---|---|---|
| 195 12 730 | 8/1996 | Germany . |
| 196 12 738 | 10/1996 | Germany . |
| 1 277 220 | 6/1972 | United Kingdom . |
| 2 316 447 | 2/1998 | United Kingdom . |

*Primary Examiner*—Andres Kashnikow
*Assistant Examiner*—Steven J. Ganey
*Attorney, Agent, or Firm*—Klaus J. Bach

[57] ABSTRACT

In a fuel injection system for a multi-cylinder internal combustion engine with magnetic valve controlled direct injection fuel injectors of which each comprises a housing consisting of several parts, one part having an injection nozzle with a spring loaded nozzle needle and another part including a control piston with a valve structure having an integral valve seat for controlling high pressure fuel admission to a fuel supply passage extending through the housing to the injection nozzle, a control chamber is formed at the other end of the control piston and is in communication with the high pressure fuel supply, and a magnetic valve arranged adjacent the control chamber controls communication of the control chamber with a drain line for releasing pressurized fuel from the control chamber to permit unseating of the control piston so as to establish communication between the pressurized fuel supply and the injection nozzle past a lug extending from the control piston into a fuel admission bore.

7 Claims, 2 Drawing Sheets

FUEL INJECTION SYSTEM FOR A MULTI-CYLINDER INTERNAL COMBUSTION ENGINE WITH MAGNETIC VALVE CONTROLLED FUEL INJECTORS

BACKGROUND OF THE INVENTION

The invention relates to a common rail fuel injection system for a multi-cylinder internal combustion engine having magnetic valve controlled direct injection fuel injection valves with a fuel admission passage leading in each valve housing to a spring-loaded nozzle needle and including a control piston with an integral control valve by which the fuel admission passage can be closed. The valve housing includes a spring space with a spring engaging the nozzle needle so as to bias it onto a nozzle needle seat, a control space disposed on the backside of the control piston which is exposed to system pressure and a cooperating magnetic valve by which the control space can be placed in communication with a pressure relief passage and by which, at the same time, the passage leading to the nozzle needle can be opened, the passage being also in communication with the pressure release passage by way of a throttled communication passage.

DE 196 12 738 A1 discloses such a common rail injection system with magnetic valve controlled fuel injection valves. It includes a control piston with an integrated valve which is guided in two housing parts and is in communication with the backside of the nozzle needle by way of the spring space. The valve is formed by an annular conical seat surface which extends downwardly from the control piston into an intermediate space for engagement with a corresponding conical valve seat formed on the housing.

It is the object of the present invention to provide a fuel injection valve having means by which the injection process can be influenced and the overall efficiency of the injection system can be improved.

SUMMARY OF THE INVENTION

In a fuel injection system for a multi-cylinder internal combustion engine with magnetic valve controlled direct injection fuel injectors of which each comprises a housing consisting of several parts, one part having an injection nozzle with a spring loaded nozzle needle and another part including a control piston with a valve structure having an integral valve seat for controlling high pressure fuel admission to a fuel supply passage extending through the housing to the injection nozzle, a control chamber is formed at the other end of the control piston and is in communication with the high pressure fuel supply and a magnetic valve arranged adjacent the control chamber controls communication of the control chamber with a drain line for releasing pressurized fuel from the control chamber to permit unseating of the control piston so as to establish communication between the pressurized fuel supply and the injection nozzle past a lug extending from the control piston into a fuel admission bore.

With the spatial separation of the control piston and the nozzle needle a steady leakage below the control piston, that is, a steady leakage possibility from the high pressure inlet to the spring space is avoided whereby the overall efficiency of the common rail injection system is improved.

With the arrangement of a throttle lug at the free end of the control piston, a desired injection process at the beginning of the injection can be achieved resulting in a smoother combustion pressure increase in the engine which, at the same time, results in a reduction of the $NO_x$ emissions.

Arranging the control piston in a single housing part has the advantage that jamming of the control piston is very unlikely to occur.

Preferably, the control piston is a two part member with two piston sections of different diameters so as to form an annular space. The two part control piston provides for a better concentricity and therefore for a more reliable seal at the high pressure end thereof.

For an injection process which is adjusted to certain requirements, a fuel admission flow cross-section effective at the beginning of each injection can be obtained according to the invention by giving the throttle pin a particular shape.

The invention will be described below in greater detail on the basis of the accompanying drawings.

DESCRIPTION OF PREFERRED EMBODIMENTS

Figure 1:
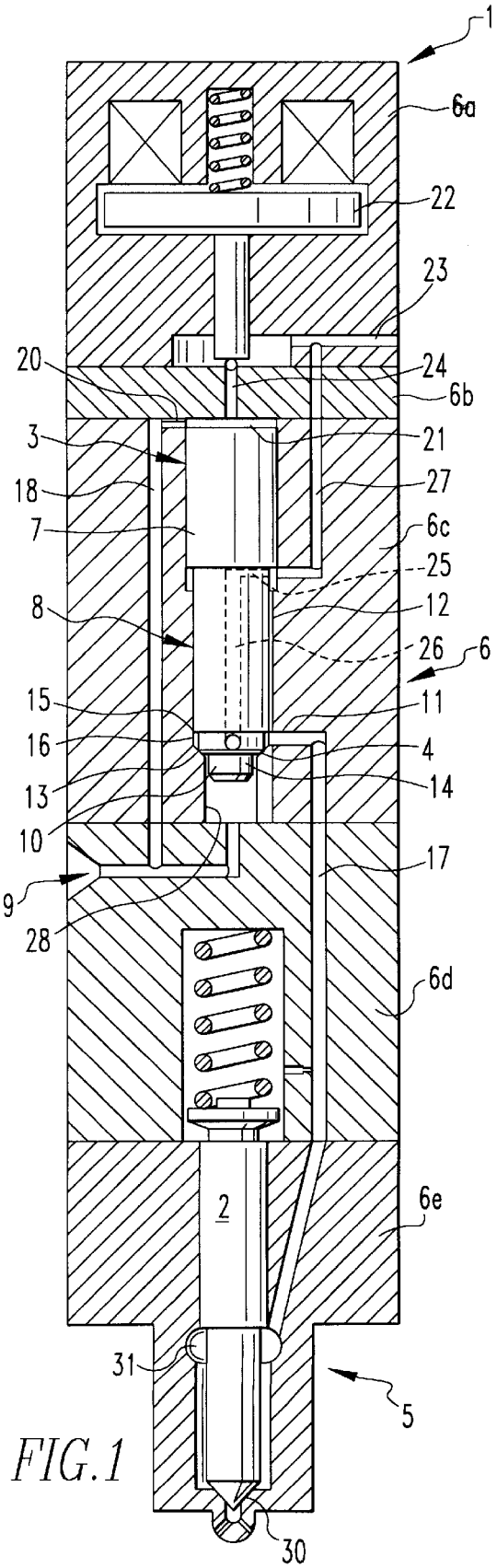
FIG. 1 shows a fuel injection valve according to the invention with a two-part control piston.

The magnetically controlled direct injection fuel valve 1 for a storage injection system utilizing the "Common Rail" principle for multi-cylinder internal combustion engines comprises a valve housing 6 consisting of several parts, 6*a*–6*e*, including an injection nozzle 5 with a spring loaded nozzle needle 2 and a control piston 3 with an integral valve 4 spatially separated from the nozzle needle 2.

As shown in FIG. 1, the control piston 3 comprises two parts axially movably disposed in a single housing part 6*c* of the valve housing 6. The upper piston part 7 has a larger diameter than the lower piston part 8 which includes at its lower end adjacent the valve a throttling lug 10 extending into a fuel admission bore 9. The lower piston part 8 has two piston sections 11, 12 of different diameters and the smaller diameter section 11 having the throttle lug 10 is provided with a cone-like valve seat surface 14 adapted to the cone-shaped valve seat 13. The smaller diameter section 11 delimits an annular space 16 which is disposed between the valve seat 13 and the transition area 15 formed between the two piston sections 11 and 12 and from which a fuel supply passage 17 extends to the nozzle needle 2.

The valve 1 includes the fuel admission bore 9 which is connected to the high pressure fuel supply storage (common rail), which is not shown in the drawings and which, by way of a supply bore 18 and a throttle 20, is in communication with a control chamber 21 on the backside of the control piston 3. This control chamber 21 is under the high supply system pressure as long as a magnetic valve 22 keeps the discharge passage 24, which leads from the control chamber 21 to a drain line 23 closed.

The upper piston part 7 of the two-part piston 3, which is subjected to the system pressure engages the lower smaller diameter piston part 8 and presses it onto the valve seat 13 so as to interrupt the high pressure fuel flow from the fuel admission bore 9, by way of the fuel supply passage 17, to the nozzle needle 2.

System pressure is released from the annular space 16 between the two piston sections 11 and 12 by a bore 26 which extends through the lower piston part 8 and includes a throttle 25 and is in communication with the drain line 23 by a connecting passage 27.

Figure 2:
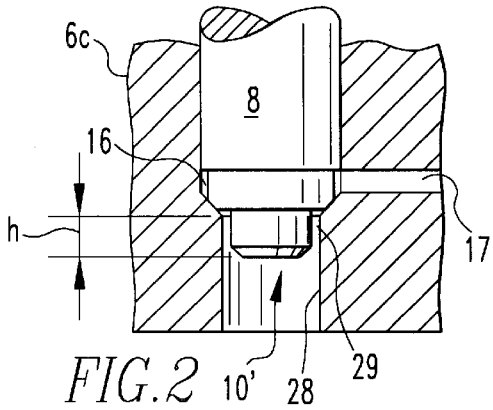
FIG. 2 shows the lower end of the control piston with a projecting throttling lug in an enlarged representation.

FIG. 2 shows a throttling lug 10' which is cylindrical and extends into a cylindrical bore section 28 of the fuel admission bore 9. The throttling lug 10' and the bore section 28 form an annular passage 29 determining a flow cross-section.

Figure 3:
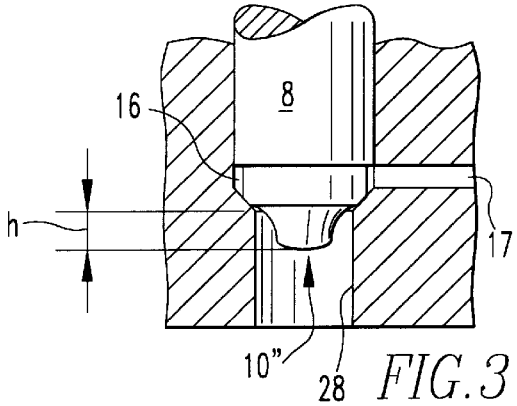
FIG. 3 shows another embodiment of a throttling lug.

FIG. 3 shows another embodiment of the throttling lug 10" which has a cross-section that becomes increasingly smaller in the cylindrical bore section 28 toward the end of the lug.

As soon as the magnetic valve 22 is energized, the pressure in the control chamber 21 above the control piston 3 collapses and, because of the pressure forces acting on the valve seat 13 that is on the lower piston part 8, the valve 13, 14 opens whereby communication between the high pressure fuel supply and the nozzle needle 2 is established. The nozzle needle 2 is lifted off the valve seat 30 against the force of its closing spring for the ejection of fuel.

The valve stroke of the control piston 3 indicated by the letter h is chosen to be greater than the lifting stroke of the nozzle needle 2. With such a relatively long valve stroke h, a progressively increasing flow cross-section can be provided during the opening phase of the valve. The initial flow cross-section is obtained, depending on the requirements, by an arrangement as shown in FIG. 2 or in FIG. 3. With the variable flow cross-section fuel is supplied to the nozzle space 31 first at a relatively slow rate so that also the injection rate increases at the beginning of the injection relatively slowly. As soon as the throttling lug 10 is lifted out of the fuel admission bore 9, the full flow cross-section of the admission bore is available for fuel flow to the fuel supply passage 17.

With the arrangement according to the invention, an injection procedure can be realized as it is most suitable for an effective combustion. It provides for a smooth combustion power increase in the combustion chamber and, at the same time, provides for lower $NO_x$ emissions.

Figure 4:
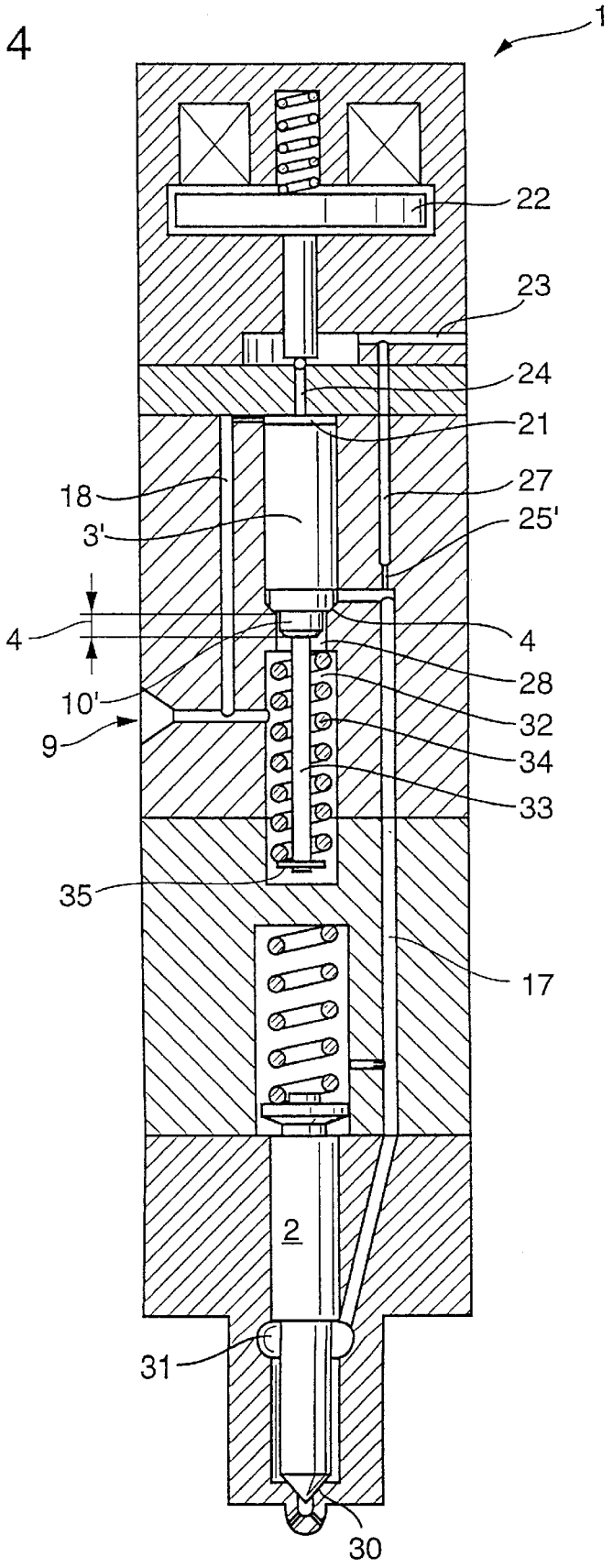
FIG. 4 shows a one piece control piston with a spring loaded pull shaft.

FIG. 4 shows a direct injection fuel valve 1 with a one-piece control piston 3' with a pull rod 33 extending from the control piston 3', that is from its throttling lug 10', into a spring chamber 32. The compression spring 34 engages at one end the housing and at the opposite end a support washer 35 mounted onto the free end of the pull rod 33. The control piston 3' is pulled by the pull rod 33 and a compression spring 34 onto the valve seat 4. The spring chamber 32 is in communication with the fuel admission bore 9 and, at the same time, serves as an additional pressurized fuel storage. The lower part of the single piece control piston 3' is formed in the same way as the lower piston part 8 of the two-part control piston 3. The throttling lug 10 may be formed as a cylindrical lug 10' as shown in FIG. 2 or as a conical lug 10" as shown in FIG. 3.

The compression spring 34 is provided to pull the control piston 3' onto its valve seat 4 since, upon closing of the magnetic valve 22, the system pressure built up on the back side of the piston equals the pressure at the opposite side of the piston 3' so that the control piston is hydraulically balanced.

With this embodiment, the control piston 3' does not include a pressure release bore, which provides for communication of the fuel supply passage 17 with the drain line 23. Rather, the fuel supply passage 17 is directly in communication with the connecting passage 27 to the drain line 23 by way of a throttle 25'.

What is claimed is:

1. A storage fuel injection system for a multi-cylinder internal combustion engine with magnetic valve controlled direct-injection fuel injectors, each comprising a housing consisting of several parts, one part having an injection nozzle with a spring loaded nozzle needle, another part including a control piston having a piston section slideably supported in said other housing part and provided at a proximal end thereof with an end section of a smaller diameter than that of said piston section so as to form an annular space around said proximal end section, said proximal end section forming a valve having a cone-shaped surface with a valve seating structure disposed in said other housing part at one end of said control piston, said control piston having a throttle lug projecting therefrom into a fuel admission bore for controlling high pressure fuel admission to a fuel supply passage extending through said housing to said injection nozzle and a control chamber formed at the distal end of said control piston opposite said proximal end thereof and being in communication with said high pressure fuel supply, and a magnetic valve arranged adjacent said control chamber for controlling a communication path to a drain line for releasing pressurized fuel from said control chamber to permit unseating of said control piston to establish communication between said pressurized fuel supply and said fuel supply passage for the ejection of fuel through said injection nozzle.

2. A fuel injection system according to claim 1, wherein said control piston consists of a single piece and is provided with a pull rod engaged by a compression spring pulling said control piston onto said valve seat.

3. A fuel injection system according to claim 2, wherein said pull rod extends into a spring chamber in which said compression spring is disposed in engagement with the housing at one end and a spring support washer mounted on the free end of said pull rod.

4. A fuel injection system according to claim 3, wherein said spring chamber is in communication with said fuel admission bore so as to be always filled with fuel under pressure and to serve as an additional pressurized fuel storage space.

5. A fuel injection system according to claim 1, wherein said control piston consists of two parts including an upper piston part delimiting said control chamber and a smaller diameter piston part on which said upper piston part is disposed, said piston parts forming around the smaller diameter lower piston part adjacent said upper piston part an annular space which is in communication with said fuel supply passage, and, by way of a throttle, with said drain line.

6. A fuel injection system according to claim 1, wherein said throttling lug and a cooperating bore section of said fuel admission bore are cylindrical in shape.

7. A fuel injection system according to claim 1, wherein said bore section of the fuel admission bore is cylindrical in shape and said throttling lug has a diameter which becomes smaller with increasing distance from said control piston.

* * * * *